United States Patent [19]

Reinehr et al.

[11] 4,356,134

[45] Oct. 26, 1982

[54] PROCESS FOR THE PRODUCTION OF HYDROPHILIC FIBRES AND FILAMENTS OF SYNTHETIC POLYMERS

[75] Inventors: Ulrich Reinehr, Dormagen; Peter Hoffmann, Leverkusen; Peter Kleinschmidt, Dormagen, all of Fed. Rep. of Germany

[73] Assignee: Bayer Aktiengesellschaft, Leverkusen, Fed. Rep. of Germany

[21] Appl. No.: 776,966

[22] Filed: Mar. 14, 1977

[30] Foreign Application Priority Data

Mar. 17, 1976 [DE] Fed. Rep. of Germany ..... 2611193

[51] Int. Cl.[3] ..... B29H 7/20

[52] U.S. Cl. ..... 264/49; 264/182; 264/206

[58] Field of Search ..... 264/206, 182, 184, 49, 264/78, 211

[56] References Cited

U.S. PATENT DOCUMENTS

| | | | |
|---|---|---|---|
| 2,073,414 | 3/1937 | Dosne | 264/203 |
| 2,075,888 | 4/1937 | Dreyfus | 264/211 |
| 2,376,934 | 5/1945 | Morgan | 264/78 |
| 2,965,437 | 12/1960 | Blomberg | 264/184 |
| 3,322,611 | 5/1967 | Stevenson | 264/184 |
| 3,773,884 | 11/1973 | Shimosaka et al. | 264/182 |
| 3,781,391 | 12/1973 | Shimosaka et al. | 264/182 |
| 3,833,708 | 9/1974 | Miller et al. | 264/49 |
| 3,852,401 | 12/1974 | Suzuki et al. | 264/182 |
| 3,896,204 | 7/1975 | Goodman et al. | 264/182 |
| 3,929,946 | 12/1975 | Orito et al. | 264/182 |
| 3,991,153 | 11/1976 | Klausner et al. | 264/182 |
| 4,035,459 | 7/1977 | Kesting | 264/49 |

FOREIGN PATENT DOCUMENTS

| | | | |
|---|---|---|---|
| 744916 | 7/1970 | Belgium | 264/182 |
| 40-21485 | 9/1965 | Japan | 264/182 |
| 41-2733 | 2/1966 | Japan | 264/182 |
| 41-6297 | 4/1966 | Japan | 264/182 |
| 46-5207 | 2/1971 | Japan | 264/182 |
| 47-15901 | 5/1972 | Japan | 264/182 |

*Primary Examiner*—Jay H. Woo

*Attorney, Agent, or Firm*—Sprung, Horn, Kramer & Woods

[57] ABSTRACT

The invention relates to a process for the production of hydrophilic filaments and fibres from a filament-forming synthetic polymer by a wet- or dry-spinning process which comprises introducing into the spinning solvent from 5 to 50% by weight of a substance with special properties defined herein and from 0.05 to 5% by weight of at least one surface-active compound as well as to hydrophilic filaments and fibres produced by such process.

4 Claims, No Drawings

PROCESS FOR THE PRODUCTION OF HYDROPHILIC FIBRES AND FILAMENTS OF SYNTHETIC POLYMERS

This invention relates to a process for improving the hygroscopic properties of fibres and filaments of synthetic polymers.

For numerous applications, for example for bed linen and underwear, it is desirable to use textile of manmade fibres which resemble natural fibres, such as cotton, in their behaviour with respect to moisture. Accordingly, there has been no shortage of attempts to improve the properties of manmade fibres which are unsatisfactory in this respect.

For example, highly hygroscopic natural fibres have been blended with synthetic fibres. It is also known that polyacrylonitrile, for example, can be mixed with a second acrylonitrile polymer containing from 30 to 80% by weight of a polyethylene oxide methacrylate, and the resulting mixtures spun (German patent specification No. 1,645,532). Acrylic fibres of this type which contain ethoxylated acrylic acid derivatives with chemically bound polyethylene oxide have long been known for their antistatic effect although their moisture regain is not particularly high. Attempts have also been made to improve the hygroscopic properties by copolymerising certain monomers.

According to Japanese patent application No. 2782/70, monomers with a hydrophilic group, for example acrylic acid derivatives, are copolymerised and subsequently hydrolysed. In German Offenlegungsschrift No. 2,061,213, acrylamide substituted by certain specified groups is proposed as comonomer.

Attempts have also been made to prove hydrophilic properties by crosslinking. German Auslegeschrift No. No 2,303,893 describes the hydrolysis with sulphuric acid of wet spun swollen acrylic fibres which contain the N-methylol compound of an unsaturated amide in copolymerised form. According to U.S. Pat. No. 3,733,386, fibres with improved moisture absorption are also obtained by crosslinking, i.e. by treating the fibres with aldehyde compounds and acids.

German patent specification No. 2,124,473 describes vacuole-containing fibres which are said to have cotton-like hydrophilic properties after treatment with a hydrophilic agent, such as sodium hydroxide, sulphuric acid or hydroxylamine. Treatment with agents such as these is unfavourable for various reasons, for example on account of the corrosion problems involved. However, in the absence of the treatment with the hydrophilic agent, the hydrophilic properties of the fibres are unsatisfactory despite the vacuoles present and the fibres can only be used to a limited extent for certain purposes because they become fuzzy and "moult". Accordingly, the process described in German patent specification No. 2,124,473 can only be used to a limited extent for the production of hydrophilic fibres and filaments on a commercial scale.

Accordingly, despite the number and variety of the methods adopted, it has not yet been possible to produce by a simple and problem-free process synthetic fibres with hygroscopic properties which even remotely approach the favourable properties of cotton. Cotton has a moisture regain of approximately 7% at 21° C./65% relative humidity and a water retention capacity (called "water of imbibition" of approximately 45%.

According to some of our own earlier proposals, hygroscopic fibres and filaments can be produced by adding to the solvent for the polymer in a wet or dry spinning process from 5 to 50% by weight, based on solvent and polymer solids, of a substance which has a higher boiling point, melting or sublimation point than the spinning solvent used, which is readily miscible with the spinning solvent and with water or another liquid and which, in addition, is a non-solvent for the polymer to be spun.

It is possible by this process to obtain filaments and fibres with a core-jacket structure which have improved hygroscopic properties compared to other synthetics, i.e. a moisture regain of at least 2% (at 21° C./65% relative humidity and a capacity of water of imbibition of at least 10%.

It has now surprisingly been found that the hygroscopic properties of the filaments or fibres can be considerably improved if, in addition to the substance already mentioned, substances which reduce the interfacial tension between water and the substrate are also added to the spinning solution. These capillary-active substances provide the filaments and fibres with an increased capacity of imbibition for absorbed liquids, for example water and perspiration.

Accordingly it is an object of this invention to provide fibres and filaments and a process for their production with improved hygroscopic properties.

It is a further object of this invention to provide fibres and filaments and a process for their production having improved moisture regain and capacity of imbibition. Still another object of the present invention is to provide fibres and filaments and especially acrylonitrile fibres and filaments and a process for their production which in some cases are superior to cotton with regard to their moisture regain and capacity of imbibition.

These and other objects, which will be evident from the following description and the examples are accomplished by a process for the production of hygroscopic filaments and fibres from a filament-forming synthetic polymer by wet or dry spinning from a spinning solvent, which comprises introducing into the spinning solvent.

(A) from 5 to 50% by weight, based on the solvent and polymer solids, of a substance which:

(a) has a higher melting or boiling point under normal conditions than the spinning solvent used;

(b) is readily miscible with the spinning solvent and with a liquid used as a washing liquid; and (c) is a non-solvent for the polymer to be spun, and (B) from 0.05 to 5% by weight, based on polymer solids, of at least one surface-active compound.

By the accumulation of substances such as these at the phase interface, the vacuoles in the microporous fibres are effective wetted and filled.

Since, in wetted porous fibres, the surface tension has a retaining effect upon the liquid filling the vacuoles, fibres such as these often have to be heated for longer periods and at higher temperatures in order to dry them, this phenomenon being known as capillary condensation.

By reducing the surface tension, the drying of fibre materials of the type in question can be accelerated, which is another advantage of the present invention.

In general, additions of from 0.05 to at most 5% by weight, based on polymer solids, are sufficient to obtain a distinctly increased hygroscopic effect. The addition preferably amounts to between 0.2 and 2% by weight.

It has been found to be necessary directly to add the capillary-active substances to the spinning solution because no improvement in hygroscopicity is obtained by treating already spun fibres or filaments with surface-active agents.

Accordingly, it is essential to the process according to the invention to add the capillary-active substances before the spinning process.

Quite surprisingly, fibres and filaments produced in this way retain their high water regain capacity even after several washes, which means that the surface-active agents are not washed out.

The surface-active agents suitable for the purposes of the invention may be anion-active, cation-active, non-ionic or amphoteric. In general, these surface-active agents are structurally characterised by a long-chain non-polar portion which has only a low affinity for water, and by a short polar portion which has a high affinity for water.

Typical anion-active agents are, for example, fatty alcohol sulphates, such as sodium stearyl sulphate, alkyl aryl sulphonates and mersolates, etc. The most important technical hydrophilic groups are carboxyl, sulphonic acid and sulphuric acid ester groups. In most cases, straight-chain hydrocarbons with about 8 to 24 carbon atoms appear as hydrophobic radicals.

One example of a cation-active agent is cetyl pyridinium chloride. In this case, the most important hydrophilic groups are a variety of amino groups and their quaternary derivatives.

The non-ionic surface-active agents do not dissociate in water. The surface-active amphoteric agents form amphoteric ions in water.

Other suitable surface-active agents are organic acids or amines which may also be present in polymeric form, for example in the form of polyacrylic acid.

However, it is also preferred to use surface-active agents of the type which are partially soluble in the spinning solvent to be used or can be dissolved in the spinning solvent after they have been made into a paste with small quantities of water.

Preferred surface-active agents include polyvinyl alcohols with K-values according to Fikentscher from 30 to 90, polyacrylic acid and also relatively high molecular weight compounds with a segment structure of hydrophilic polyglycol ether segments and hydrophobic segments, of the type described in German Offenlegungsschrift No. 1,495,749 and German Auslegeschrift No. 2,105,681.

It has also been found that, in cases where polymeric surface-active agents are added, the hygroscopicity of the fibres produced by the process according to the invention increases with increasing molecular weight of the agents added. A measure of the molecular weight of these agents is the so-called saponification number. It is determined by the number of mg of KOH which is required for hydrolysing 1 g of the substance.

The polymers used for producing the filaments and fibres are preferably acrylonitrile polymers, of which those consisting of at least 50% by weight of acrylonitrile units are preferred.

In cases where acrylonitrile polymers are used, the hygroscopicity of the fibres may be further increased by using copolymers which contain comonomers having hydrophilic groups such as amino, sulpho, hydroxyl-N-methylol or carboxyl groups. Particularly suitable compounds are, for example, acrylic acid, methacrylic acid, methallyl sulphonic acid, acrylamides and the N-methylol compounds of an unsaturated acid amide for example, N-methylol acrylamide and N-methylol methacrylamide. Mixtures of polymers may also be used.

Suitable spinning solvents are the solvents normally used for dry or wet spinning, for example dimethyl acetamide, dimethyl sulphoxide, N-methyl pyrrolidone, preferably dimethyl formamide.

The substance described under (A) which is added to the spinning solvent has to satisfy the following requirements: its melting point or boiling point under normal conditions must be higher, preferably 50° C. or more higher than that of the solvent; it must be miscible, preferably in any ratio, with the solvent and also with water or with any other liquid suitable for use as a washing liquid, and must be a non-solvent in the practical sense for the polymer used, i.e. the polymer be insoluble or should only dissolve to a limited extent in this substance.

Substances such as these are, for example, monosubstituted and polysubstituted alkyl ethers and esters of polyhydric alcohols, such as for example diethylene glycol mono- or -dimethyl, -ethyl and-butyl ether, diethylene glycol, triethylene glycol, tripropylene glycol, triethylene glycol diacetate, tetraethylene glycol, tetraethylene glycol dimethyl ether, glycol ether acetates, for example, butyl glycol acetate. High-boiling alcohols such as, for example, 2-ethyl cyclohexanol, esters or ketones, or even mixtures, for example of ethylene glycol acetates, are also suitable.

It is preferred to use glycerol and its homologs.

In addition to an individual substance, it is of course also possible to use mixtures. One important factor is that the substances used should be readily soluble in water or in any other liquid used as washing liquid, such as alcohol for example, so that they may be removed during the aftertreatment of the fibres.

In addition, it is advantageous to use substances which do not form any azeotropic mixtures with the spinning solvent used or sublime so that, as in the case of DMF-glycerol or DMF-diethylene glycol mixtures, they may be almost completely recovered by fractional distillation.

These substances are added to the spinning solvent in quantities of from 5 to 50% by weight and preferably in quantities of from 10 to 20% by weight, based on solvent and polymer solids. The upper limit to the amount of substance added is determined in practice by the spinnability of the polymer solution. The higher the ratio by weight of added substance to the spinning solvent, the greater the degree of porosity in the fibre core and the higher the hygroscopicity of filaments produced from spinning solution mixtures such as these.

In the case of glycerol, up to about 16% by weight may be added to a 17% by weight polyacrylonitrile solution in DMF. In order to obtain thorough admixture of the spinning solution, it is best to add the spinning solvent, for example DMF, with the relatively high boiling liquid first of all and then to add the polymer powder to the thoroughly stirred solution because precipitation has been observed in cases where glycerol is directly added to polyacrylonitrile solutions in DMF.

As already mentioned, the filaments and fibres according to the invention have a core-jacket structure. In these core-jacket structures, the core is microporous, the average pore diameter amounting to at most 1$\mu$. In general, it is between 0.5 and 1$\mu$. The surface area of the core in a cross-section through the fibres generally amounts to approximately 70% of the total cross-sectional area.

The jacket may be compact or also microporous, depending upon the aftertreatment conditions selected.

Whereas the cross-sectional form of conventional dry spun filaments and fibres is the known dumb-bell or bone form, the filaments and fibres according to the present invention mainly have other cross-sectional forms. Thus, the filaments and fibres according to the invention contain irregular trilobal, mushroom-shaped, round and bean-shaped structures, in some cases alongside one another. The predominant cross-sectional form is governed both by the spinning conditions selected and also by the quantity of liquid added to the spinning solvent, the latter factor having the greater influence. Even during wet spinning, bean-shaped indented cross-sectional forms are not obtained, as is normally the case, instead round core-jacket fibres are preferably obtained.

In addition to the hygroscopic properties described, the filaments and fibres according to the invention show favourable fibre properties, such as high tensile strength, elongation at break and good dyeability.

Although thus far the description has been confined to acrylic fibres and their production, the invention is by no means limited to acrylic fibres. Modacrylic and linear aromatic polyamides, for example, the polyamide of m-phenylene diamine and isophthallyl chloride, or those which optionally contain heterocyclic ring systems for example, polybenzimidazoles, oxazoles, thiazoles etc., and which may be produced either by a wet or dry spinning process, may also be used in accordance with the invention.

The capacity of water of imbibition of fibres is an important physical parameter in cases where they are used for clothing. the effect of that capacity is that, in the event of heavy perspiration, textiles worn close to the skin are able to keep the skin relatively dry and hence to improve wearing comfort.

Determination of water of imbibition capacity (WR):

The capacity of water of imbibition is determined in accordance with DIN 53814 (cf. Melliand Textilberichte 4 1973, page 350).

The fibre samples are immersed for 2 hours in water containing 0.1% wetting agent. Thereafter the fibres are centrifuged for 10 minutes with an acceleration of 10,000 m/sec$^2$ and the quantity of water retained in and between the fibres is gravimetrically determined. In order to determine their dry weight, the fibres are dried at 105° C. until they have a constant moisture content. The water of imbibition (WR) in % by weight is:

$$WR = \frac{m_f - m_{tr}}{m_{tr}} \times 100$$

$m_f$=weight of the moist fibres $m_{tr}$=weight of the dry fibres

Determination of moisture regain capacity (MA):

The moisture regain of the fibres, based on their dry weight, is gravimetrically determined. To this end, the samples are exposed for 24 hours to a climate of 21° C./65% relative air humidity.

To determine their dry weight, the samples are dried at 105° C. until constant in weight. The moisture regain (MA) in % by weight is:

$$MA = \frac{m_f - m_{tr}}{m_{tr}} \times 100$$

$m_f$=moist weight of the fibres at 21° C./65% relative humidity $m_{tr}$=dry weight of the fibres.

The invention is further illustrated but by no means limited by the following Examples, in which the parts and percentages quoted are based on weight, unless otherwise stated.

EXAMPLE 1

19.9 kg of DMF were mixed while stirring in a vessel with 4.8 kg of glycerol. 5.1 kg of an acrylonitrile copolymer of 93.6% consisting of acrylonitrile, 5.7% of methyl acrylate and 0.7% of sodium methallyl sulphonate and also 25.5 g (0.5% by weight, based on PAN solids) of polyvinyl alcohol with a molecular weight of about 12,000 (saponification number 4-98) were then added while stirring, followed by stirring for 1 hour at 80° C. and filtration. The spinning solution thus obtained is dry spun from a 180-bore spinneret in a spinning duct by methods known in the art.

The spinning duct temperature was 160° C. The viscosity of the spinning solution, which had a solids concentration of 17% and a glycerol content of 15.7% by weight, based on DMF+polyacrylonitrile powder, amounted to 85 ball drop seconds. For determining viscosity by the dropped ball method, see K. Jost, Rheologica Acta, Vol. 1, No. 2-3 (1958), page 303. The spun material with a denier of 1700 dtex was collected on bobbins and doubled into a tow with an overall denier of 102,000. After leaving the spinning duct, the sliver still contained 14.1% by weight of glycerol.

The glycerol content of the spun sliver was determined by gas-chromatographic analysis. The tow was then drawn in a ratio of 1:3.6 in boiling water, washed for 3 minutes under low tension in boiling water and treated with an antistatic preparation. It was then dried in a screen drum dryer at a maximum of 130° C. with 20% permitted shrinkage and cut into fibres with a staple length of 60 mm.

The individual fibres with a final denier of 3.3 dtex had a moisture regain of 3.2% and a water of imbibition of 90%. Tensile strength: 2.6 p/dtex; elongation at break: 41%.

The fibres had a pronounced core-jacket structure with irregular, generally trilobal cross-sectional forms.

The hem width of the jacket surface amounted to approximately 4 μm. By quantitative analysis with a Leitz "Classimat" picture analyser, more than 100 fibre cross-sections were evaluated for determining the core and jacket surface of the fibres. It was found that an average of 32% of the cross-sectional surface was occupied by the hem width of the jacket.

The fibres could be deeply dyed throughout with a blue dye of the formula

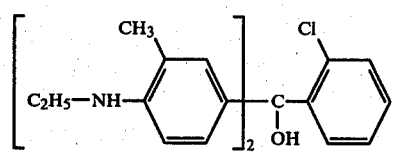

The extinction value amounted to 1.39 for 100 mg of fibre per 100 ml of DMF (570 mμ, 1 cm cuvette).

The following Table shows other surface-active agents which are added to polyacrylonitrile spinning solutions under the same conditions and in the same quantities as described in Example 1, spun into fibres and aftertreated.

The water retention capacity and moisture regain of the fibres with a final denier of 3.3 dtex was again determined.

| No. | Surface-active agent | Water of imbibition (%) | Moisture regain (%) |
|---|---|---|---|
| 1a | polyvinyl alcohol, saponification number 70–98, molecular weight approx. 37,000 | 150 | 3.2 |
| 1b | polyvinyl alcohol, saponification number 90–98, molecular weight approx. 73,000 | 190 | 3.4 |
| 1c | polyacrylic acid, molecular weight approx. 12,000 | 145 | 4.9 |

As can be seen from the Table, hygroscopicity increases considerably with increasing molecular weight in cases where polyvinyl alcohol is used as the surface-active substance. The increased moisture regain in the case of polyacrylic acid as capillary-active substance is explained by the increased number of carboxyl groups in the fibres.

EXAMPLE 2

20.0 kg of DMF were mixed while stirring in a vessel with 2.95 kg of glycerol. 6.5 kg of an acrylonitrile copolymer with the same chemical composition as in Example 1 and 32.5 g (0.5% by weight, based on PAN solids) of polyvinyl alcohol with a molecular weight of about 73,000 (saponification number 90-98) were then added while stirring, followed by stirring for 1 hour at 80° C. and filtration. The spinning solution thus produced was wet spun from a 150 bore spinneret by methods known in the art. The precipitation bath consisted of 45% of DMF and 55% of water.

The precipitation bath temperature was 56° C. and the take-off rate 5 m/minute.

The viscosity of the spinning solution, which had a solids concentration of 22% and a glycerol content of 10% by weight, based on DMF+polyacrylonitrile powder, amounted to 135 poises.

The spun material with a denier of 1470 dtex was collected on bobbins and doubled into a tow with an overall denier of 102,900. The tow was then drawn in a ratio of 1:4.5 in boiling water, washed in boiling water for 3 minutes under low tension and treated with antistatic preparation.

The tow was then dried in a screen drum dryer at a maximum of 140° C. with 20% permitted shrinkage and cut into fibres with a staple length of 60 mm.

The individual fibres with a final denier of 2.7 dtex had a moisture regain of 2.7% and a water of imbibition of 180%. They again had a pronounced core-jacket structure with substantially circular cross-sectional forms.

EXAMPLE 3

(Comparison)

(a) An acrylonitrile copolymer with the same chemical composition as in Example 1 was dry spun under the same conditions as in Example 1 from a DMF glycerol mixture to which no polyvinyl alcohol had been added, and the spun material was aftertreated to form fibres.

The individual fibres with a final denier of 3.3 dtex had a moisture regain of 3.1% and a water of imbibition of 48%.

(b) Part of the same acrylonitrile copolymer was wet spun under the same conditions as in Example 2, but without any addition of polyvinyl alcohol, and aftertreated to form fibres with a final denier of 2.7 dtex. Moisture regain 2.7%; water of imbibition 38%.

What is claimed is:

1. A process for the production of hydrophilic polyacrylonitrile filaments and fibers having a sheath-core structure and a microporous core which comprises spinning a fiber forming wet or dry spinnable polyacrylonitrile as a composition containing, in addition to the spinning solvent (A) from 5 to 50% by weight, based on the spinning solvent and polymer solids content, of non-solvent for the polymer to be spun, which non-solvent
  (a) has a higher melting or boiling point under normal conditions than the spinning solvent,
  (b) is miscible with the spinning solvent and with a liquid suitable for use as a washing liquid; and washing said non-solvent from said filaments or fibers; the improvement comprising including in said composition (B) from 0.05 to 5% by weight, based on polyacrylonitrile solids content of at least one surface-active compound; and thereafter removing said solvent and said non-solvent.

2. The process of claim 1, wherein said acrylonitrile polymer consists of at least 50% by weight of acrylonitrile units.

3. The process of claim 1 in which the hydrophilic filaments or fibers formed have an average pore size of at most one micron in the microporous core.

4. The process of claim 1 in which the hydrophilic filaments or fibers produced have greater hydrophilic properties than the fibers or filaments produced by a corresponding process which differs only in that said surface-active compound is omitted.

* * * * *